US005471908A

United States Patent [19]

Lech

[11] Patent Number: 5,471,908

[45] Date of Patent: Dec. 5, 1995

[54] HYDRAULIC SYSTEM FOR BACKHOE

[75] Inventor: Richard J. Lech, Burlington, Iowa

[73] Assignee: Case Corporation, Racine, Wis.

[21] Appl. No.: 349,133

[22] Filed: Dec. 2, 1994

Related U.S. Application Data

[63] Continuation-in-part of Ser. No. 197,253, Feb. 16, 1994, abandoned.

[51] Int. Cl.[6] ..... F15B 11/00; F16D 31/02

[52] U.S. Cl. ..... 91/516; 91/532; 60/424; 60/426

[58] Field of Search ..... 91/516, 518, 532, 91/520; 60/420, 426, 424

[56] References Cited

U.S. PATENT DOCUMENTS

| | | | |
|---|---|---|---|
| 3,298,548 | 1/1967 | Long et al. | 214/138 |
| 3,590,580 | 7/1971 | Vaughan | 60/426 X |
| 3,624,785 | 11/1971 | Wilson | 214/138 |
| 3,901,395 | 8/1975 | King | 91/516 X |
| 4,184,560 | 1/1980 | Tischer | 60/420 X |
| 4,485,623 | 12/1984 | Chichester et al. | 91/516 X |
| 4,635,439 | 1/1987 | Wible | 60/426 X |
| 4,815,357 | 3/1989 | Truehart | 91/516 |
| 4,966,066 | 10/1990 | Kauss et al. | 91/516 |
| 5,048,293 | 9/1991 | Aoyagi | 60/420 |
| 5,072,802 | 12/1991 | Tischer | 91/516 X |
| 5,313,795 | 5/1994 | Dunn | 91/518 X |

*Primary Examiner*—Edward K. Look
*Assistant Examiner*—Hoang Nguyen
*Attorney, Agent, or Firm*—Jansson & Shupe, Ltd.

[57] ABSTRACT

Disclosed is a hydraulic system for a machine having a pump, a steering circuit and first and second hydraulic implements, e.g., a hydraulic loader and a backhoe, powered by first and second valve sections, respectively. In the improvement, the system includes a priority valve receiving fluid from the pump and configured for movement between a first position and a second position. In the first position, the priority valve flows fluid to the steering circuit and to the second valve section and in the second position, the priority valve flows fluid to the both valve sections which are connected in series.

12 Claims, 4 Drawing Sheets

FIG. 2
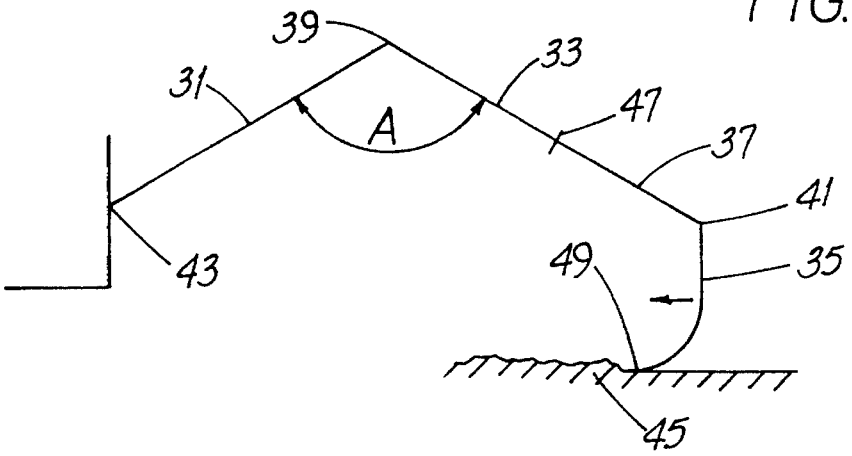
FIG. 3
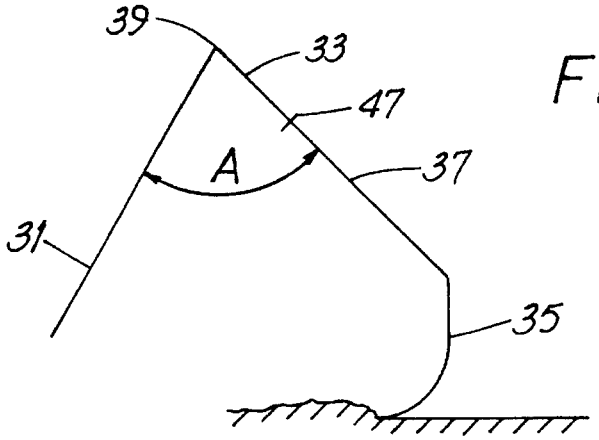
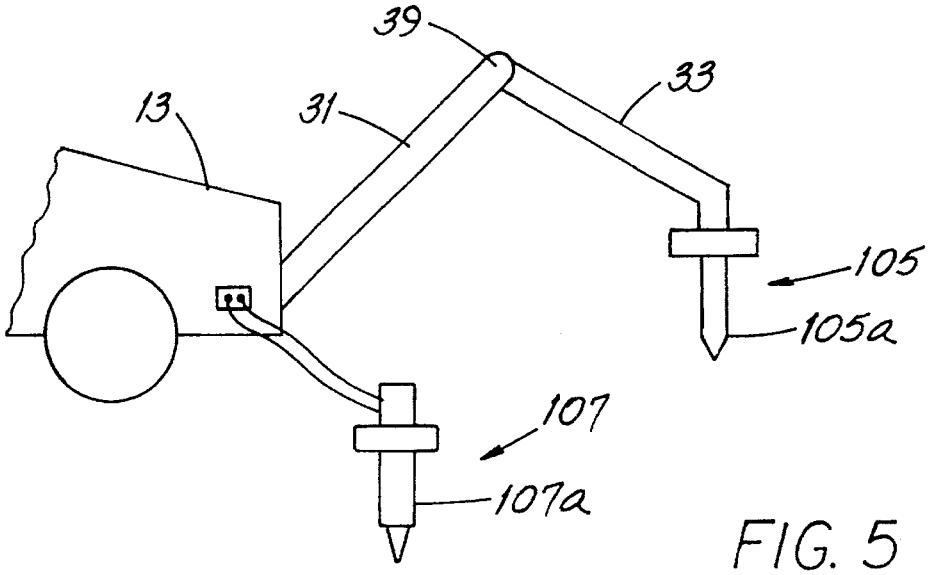
FIG. 5

HYDRAULIC SYSTEM FOR BACKHOE

RELATED APPLICATION

This application is a continuation-in-part of application Ser. No. 08/197,253 filed on Feb. 16, 1994 and now abandoned.

FIELD OF THE INVENTION

This invention relates generally to mobile machinery and, more particularly, to earthmoving and digging machinery.

BACKGROUND OF THE INVENTION

Mobile machinery, i.e., machinery capable of self=propelled movement across a floor or earthen surface, is available in a wide variety of configurations. Each is designed for a particular purpose or for a few related purposes such as material handling or earthmoving and digging. Machines of the latter type, often referred as "construction machinery," include backhoes, front end loaders and "hybrids," loader-backhoes.

Advantageously, the working implements of backhoes, front end loaders and hybrid machines are powered by a hydraulic system controlled by lever-like handles mounted in the operator's compartment. Such handles actuate hydraulic valves which operate hydraulic cylinders and, frequently, rotary motors to power auxiliary equipment.

A front end loader is a machine mounted on crawler tracks or rubber tires and having a scoop-like bucket mounted on a pair of boom-like arms attached to the front of the machine. The height and attitude of the bucket are controlled by the operator to move material from one place to another, e.g., to remove snow from a pile and place it into a haulage truck. Of course, many other types of material moving and digging tasks are possible with a front end loader.

A backhoe (which may also be crawler or rubber mounted) has a bucket mounted at the end of an articulated arm. Such arm has inner and outer stick-like "elements" known as the boom and the dipper, respectively.

(One may closely approximate the boom, dipper and bucket by extending an arm—albeit somewhat uncomfortably—to an "elbow-up" and "wrist-up" attitude with the hand cupped, analogous to the bucket, and the fingers facing rearward, analogous to the bucket teeth. The shoulder represents the boom connection to the machine and the backhoe articulated arm "pivot points" correspond to the shoulder, the elbow and the wrist.)

The boom, dipper and bucket are mounted at the rear of the machine. The operator faces forward when moving the machine from place to place and rearward when operating the backhoe. Backhoes are frequently used for such tasks as digging trenches for water pipes or the like.

Inevitably, a hybrid machine emerged which has both a front end loader and a rear-mounted backhoe. Since the loader function is nearly always used when moving the machine and since the backhoe function is nearly always used (or should be used) only when the machine is stationary and braced by outrigger-like stabilizers, this was a natural evolution.

At least early as the mid-1960's, backhoes were developed in which the dipper—analogous to the human forearm—is extensible or telescoping. A telescoping dipper permits the operator to dig more deeply, reach further to unload the bucket and reach over obstacles, to name but a few advantages. Exemplary backhoes with extensible dippers are depicted in U.S. Pat. Nos. 3,298,548 (Long et al.) and 3,624,785 (Wilson).

U.S. Pat. No. 5,313,795 (Dunn) shows a circuit for use on a hydraulic backhoe while U.S. Pat. No. 4,966,066 (Kauss et al.) shows a two-priority-valve circuit used with a utility vehicle pulling a trailer. Such circuit uses a variable-displacement pump with a pressure/flow compensator and prioritizes steering, trailer brakes and auxiliary devices in that order.

And backhoes may be equipped with "attachment" valves to which auxiliary hydraulic tools may be connected for operation from the machine hydraulic system. Such tools may be of the "high flow" fully mounted type or of the "low flow" hand-operated type. An example of the former is a large auger or pavement breaker mechanically mounted on the outer end of the dipper in place of the bucket. Such tools require relatively high hydraulic fluid flow rates, e.g., 20–30 gallons/minute (GPM), and are operated using what may be referred to as a mounted attachment valve. ("Mounted" refers to the tool, not the valve which is always mounted on the machine.)

On the other hand, hydraulically-powered, hand-operated tools, e.g., jackhammers and the like, are attached to the machine only by hydraulic hoses coupled to what may be referred to as a hand-held attachment valve. Such hand-operated tools may require flow rates in the range of 3 to 12 GPM or so. (As with the term "mounted," the term "hand-held" refers to the tool, not the valve controlling the tool.)

While backhoes (with or without extensible dippers) have been used mostly for digging, what may be described as a phenomenon has become evident. That is, operators of such machines are using the backhoes not only for digging but also as a "fine grading" implement. In so doing, the operator moves the bucket teeth across the ground or along a vertical or angled surface in a way to smooth such surface and make it generally flat.

Even if the backhoe has no extensible dipper, performing fine grading with a backhoe is a tricky task and requires very close control by the operator. This is due in large part to the triangular shape generally defined by the boom and dipper during fine grading. To keep the bucket teeth moving in a generally straight-line path, the boom, dipper and bucket positions must all be controlled simultaneously and accurately. And the inclusion of an extensible dipper adds another level of complexity to the control task. A leading manufacturer of machines of the foregoing types is Case Corporation of Racine, Wis.

While machines of the foregoing types have been generally satisfactory for their intended purpose, they tend to be characterized by certain disadvantages. Some of these disadvantages arise from emerging new patterns of use.

For example, operating the conventional backhoe valves to manipulate the swing, boom, dipper and bucket may "starve" the extend valve and its circuit used for extending and, more particularly, retracting the dipper during fine grading. Dipper retraction thus becomes erratic and the surface to be graded is made undesirably uneven.

Yet another disadvantage relates to the fact that most backhoes are equipped with two hydraulic pumps, the output flow rates of which may differ from one another by a ratio as high as 2:1 or more. To cite an example, a backhoe may have a 12 GPM pump and a 24 GPM pump, both flow rates being at rated engine speed.

In known arrangements involving attached hand-held tools, it is common practice to power such tools from the smaller of the two pumps while operating the engine at about rated speed. However, this means that the output flow from the larger pump (like that from the smaller pump) also circulates through the hydraulic system.

Inevitably, hydraulic systems having oil circulating therein evidence "pressure drop" as the oil moves through piping and valves and otherwise around the system. By a known equation, pressure drop and flow rate relate to horsepower and in such circulating systems, these horsepower losses (which are manifested as unwanted heat in the hydraulic system) are known as "parasitic losses." Such losses translate into higher (and with the advent of the invention, unnecessary) operating costs, engine wear, exhaust fumes and the like.

And excess heat manifested in high oil temperature is undesirable for a more subtle reason. The temperature of the hand-held tool, being hydraulically operated, tends to rise toward that of the hydraulic oil passing through it. At some point, the tool may be too hot to handle, at least comfortably.

An improved hydraulic system which addresses such disadvantages would be an important advance in the art.

OBJECTS OF THE INVENTION

It is an object of the invention to provide an improved hydraulic system overcoming some of the problems and shortcomings of the prior art.

Another object of the invention is to provide an improved hydraulic system which helps assure that a dipper extend/retract function is adequately supplied with hydraulic fluid.

Another object of the invention is to provide an improved hydraulic system for machines having two pumps of disparate size which allows the larger of the pumps to supply attachment valve(s).

Yet another object of the invention is to provide an improved hydraulic system which reduces parasitic losses.

Another object of the invention is to provide an improved hydraulic system which helps reduce the temperature of hand-held attachment tools.

Another object of the invention is to provide an improved hydraulic system which can reduce operating costs, engine wear, exhaust fumes and ambient noise. How these and other objects are accomplished will become apparent from the following descriptions and from the drawing.

SUMMARY OF THE INVENTION

The invention involves a hydraulic system for a machine having a first hydraulic pump, a steering circuit and two implements, e.g., a bucket and a backhoe, powered by first and second hydraulic valve sections, respectively. The exemplary backhoe is of the type having an extensible boom.

The first section has a priority valve prioritizing flow between the sections. In one arrangement, the first section "has priority" and the second section receives hydraulic fluid only when the first section is not in use.

The second section has a second implement valve (for controlling, e.g., a backhoe-related function) and also has an extend valve. Such extend valve is mounted for movement between a neutral position and an operating position for controlling the extensible dipper portion of the backhoe. In the improvement, the second section includes a second priority valve prioritizing flow between the second implement valve and the extend valve. That is, in the preferred embodiment, the extend valve "has priority" and the second implement valve receives fluid only when and to the extent the flow requirements of the extend valve (and, thus, the dipper extensible portion controlled thereby) are met.

In a specific embodiment of the invention, the second priority valve has a supply port for receiving hydraulic fluid, the flow of which is prioritized by such valve. The supply port is connected to the first section which has a bucket control valve configured for movement between a neutral position and an operating position. Preferably, the supply port receives fluid only when the bucket control valve is in the neutral position. This configuration recognizes the fact that the bucket and the backhoe are operated alternately, not simultaneously, or at least should be so operated.

In another aspect of the invention, the second priority valve directs fluid to the second implement valve (controlling a backhoe-related function) when the extend valve is in the neutral position. Preferably, the second implement valve and the extend valve are connected in parallel to the second priority valve rather than in series thereto.

The second embodiment of the new system has but a single priority valve. Both of the valve sections are fed by the first pump. In the improvement, the system includes a priority valve receiving fluid from the pump and configured for movement between a first position and a second position.

In the first position, the priority valve flows fluid to the steering circuit and to the second valve section, the latter having first and and second implement valves which are in parallel with the steering circuit. If the machine is of the type having an attachment valve section for powering mounted and hand-held tools, the priority valve also flows fluid to the attachment valve section when such priority valve is in the first position.

More specifically, the priority valve flows fluid to the first and second implement valves of the second valve section (as well as to the steering circuit) when such priority valve is in the first position. In the second position, the priority valve flows fluid to the first valve section and to the second valve section and such sections are preferably connected in series. No fluid is provided to the steering circuit when the priority valve is in the second position.

In another aspect of the invention, the system has a pilot line communicating a pressure signal to the priority valve. Such pilot line is connected to the priority valve, to the first and second implement valves and to the attachment valve section if the machine is equipped with such a section.

The inventive hydraulic system addresses a number of important factors. Among them is the fact that, increasingly, operators of machines having extensible dippers are using the machine to perform fine grading. Insofar as is known, the system is the first to provide priority flow to the extensible dipper so that the contour of the earth surface may be more closely controlled.

Another factor involves increasing use of attachments and the propensity of independent suppliers to offer "add-on" hydraulic subsystems which are not engineered specifically for the machine on which such subsystem is to be mounted. The invention provides features permitting operation of attached tools while still assuring adequate flow to the extensible boom.

Yet another factor involves machine wear, environmental noise and the like. With the improved system, an attached tool can be operated from the larger of two machine hydraulic pumps driven at relatively low engine speed, e.g., engine idle. This reduces parasitic hydraulic losses, engine wear, engine exhaust and ambient engine noise.

Still another factor is that in the second embodiment, the system uses but a single priority valve to provide priority flow to several different functions.

Other aspects of the invention are set forth in the following detailed description and in the drawing.

BRIEF DESCRIPTION OF THE DRAWING

FIG. 2 is a representative side elevation view of the backhoe portion of the machine of FIG. 1 showing such portion in an extended position.

FIG. 3 is a representative side elevation view of the backhoe portion of FIG. 2 showing such portion in a partially retracted position.

FIG. 5 is a representative side elevation view of the backhoe portion shown in conjunction with a fully mounted hydraulic tool and with a hand-held hydraulic tool.

DETAILED DESCRIPTIONS OF PREFERRED EMBODIMENTS

Figure 1:
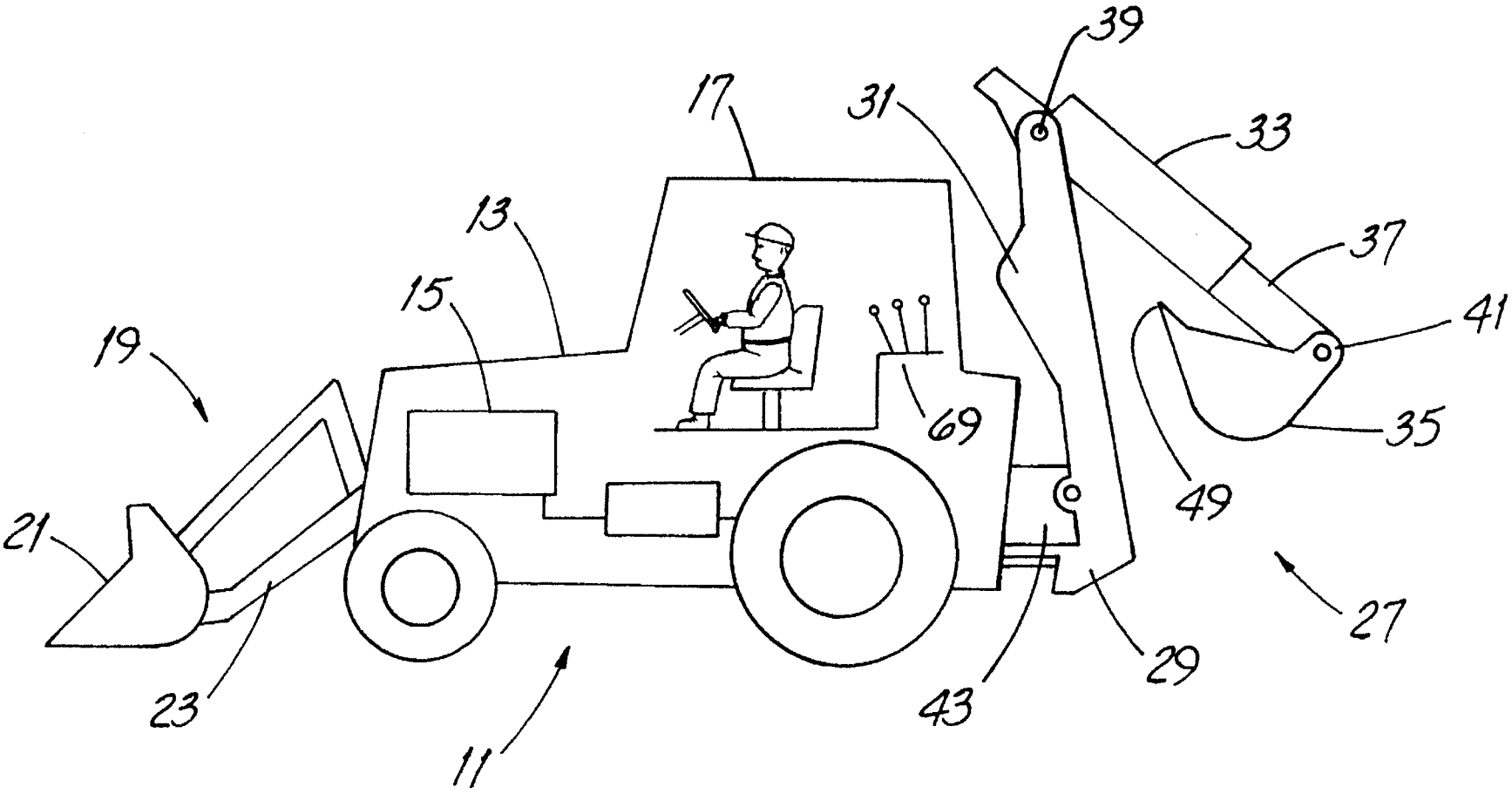
FIG. 1 is a representative view of a loader-backhoe machine.
Figure 4:
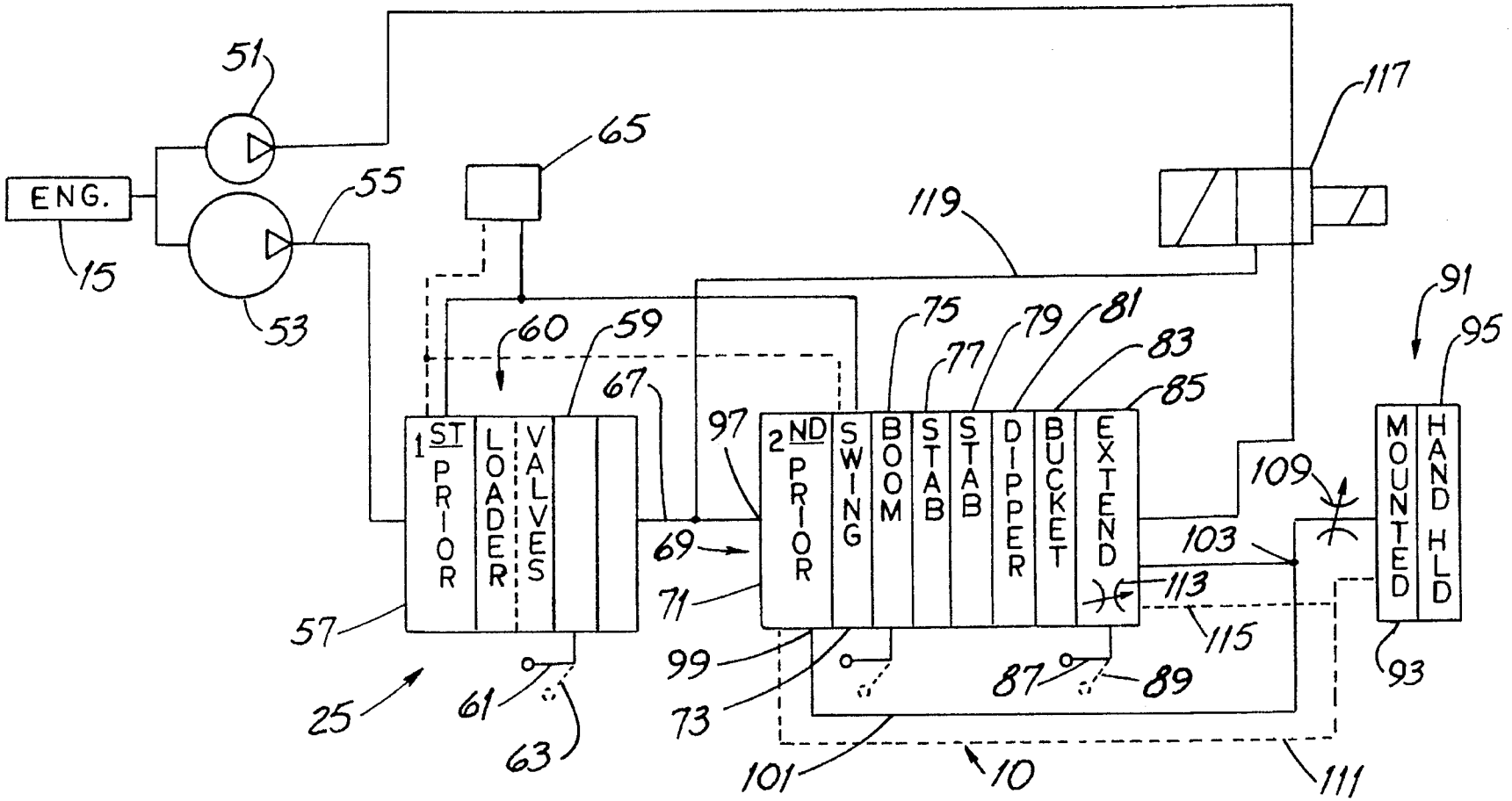
FIG. 4 is a block circuit diagram of one embodiment of a hydraulic system suitable for use with the loader-backhoe of FIG. 1.

Referring to FIGS. 1 and 4, the improved hydraulic system 10 is disclosed in connection with a machine 11 embodied as an exemplary loader-backhoe 13. The loader-backhoe 13 of FIG. 1 includes a chassis having an engine 15, an operator's cab 17, and a first implement 19, e.g., a loader bucket 21 mounted on pivoting arms 23. The positions of the bucket 21 and the arms 23 are controlled by a first valve section 25 in the cab 17.

The machine 11 also has a second implement 27, e.g., a rear-mounted backhoe 29 with a boom 31, a dipper 33 and a bucket 35 attached to the end of the dipper 33. The dipper 33 has a telescoping extensible portion 37 configured and arranged so that such portion 37 may be extended toward and away from the joint 39. From FIG. 1, it is apparent that when the portion 37 is extended to the rear of the machine 11, the "reach" of the backhoe 13 (horizontally, vertically as into a trench, or a combination thereof) is significantly improved.

It is to be appreciated that the backhoe 29 pivots at the joint 39 between the boom 31 and the dipper 33 and at the joint 41 between the dipper 33 and the bucket 35. The backhoe 29 also pivots left-and-right (in the drawing, into and out of the paper) about the joint 43. Because of such configuration, the bucket 35 has what is known as "three axes of movement," i.e., it can be moved in any direction.

FIGS. 2 and 3 generally illustrate the motion of the bucket 35 and how the positional relationships of the boom 31, the dipper 33, the extensible portion 37 and the bucket 35 change with respect to one another while using the backhoe 29 for fine grading of earth 45. When the backhoe 29 and the portion 37 "reach" as in FIG. 2, the boom 31 and the dipper 33 define a relatively large obtuse angle "A" the upper end 47 of the extensible portion 37 is relatively far from the joint 39 and the "wrist" joint 41 bent, i.e., the bucket 35 is significantly "cocked" with respect to the extensible portion 37. The position of FIG. 2 approximates that at the start of fine grading.

In FIG. 3 (which represents the end of a fine grading "stroke"), the angle "A" is much smaller, the end 47 of the extensible portion 37 is relatively near the joint 39. And the bucket 35 is more nearly aligned with the dipper 33.

From the foregoing and from a comparison of FIGS. 2 and 3, it is now apparent that during fine grading, an operator must often manipulate the hydraulic valves for the boom 31, the dipper 33, the extensible portion 37 and the bucket 35 simultaneously to keep the bucket teeth 49 moving in a straight line. One can now appreciate how the task is made even more complex if while moving, say, the boom 31, the extensible portion 37 momentarily "stalls" because its hydraulic circuit is starved for fluid.

Referring also to FIG. 4, the hydraulic system 10 will now be explained. Such system 10 has a pair of hydraulic pumps 51, 53 driven by the machine engine 15. The diameters of the circles representing such pumps 51, 53 symbolize the small pump 51 and the large pump 53, respectively.

The output flow of the large pump 53 is directed along the line 55 to a first valve section 25 which has a first priority valve 57 and at least one loader bucket control valve 59 (typically, several such valves 60) for controlling the loader bucket 21. The exemplary valve 59 is configured for movement between a neutral position 61 and an operating position 63.

The system 10 also has a hydraulic steering circuit 65 much like a power steering system in an automobile. The priority valve 57 helps assure that the needs of such circuit 65 are satisfied as the remainder of the available fluid flow is directed to the loader bucket control valves 59, 60.

For example, the pump 53 may provide 24 GPM at rated engine speed but the circuit 65 may only require about 3 GPM or so. The first priority valve 57 helps assure the latter flow rate is maintained.

When the loader valves 60 and the steering circuit 65 are not in use (as is the case during backhoe operation), hydraulic fluid from the pump 53 and the line 55 are ported through the valves 60 and along the line 67 to a second valve section 69. Such section 69 has a second priority valve 71 and at least one valve for controlling the second implement 27.

More typically, such section has several implement valves, e.g., individual valves 73, 75, 77, 79, 81, 83, and 85 for the backhoe swing, boom, stabilizers, dipper, bucket and "extend," respectively. The latter valve 85 is configured for movement between a neutral position 87 and an operating position 89 and moves the extensible portion 37. Optionally, there is also an attachment valve section 91 having valves 93 and 95 for fully mounted tools and hand-held tools, respectively.

The second priority valve 71 has an inlet supply port 97 and an output port 99, the latter directing fluid to the line 101 on a priority basis. That is, fluid is available for the valves 73, 75, 77, 79, 81 and 83 only when the needs of the extend valve 85 and/or the attachment valve section 91 are met. The "T" junction 103 connects such valve 85 and section 91 in parallel.

Referring also to FIG. 5, the attachment section 91 has a fluid flow requirement whenever a fully mounted tool 105, e.g, a pavement breaker, auger or the like 105*a*, and/or a hand-held tool 107, e.g, a hydraulic jack hammer, drill or the like 107*a*, are attached to the machine 11 and being operated. Such flow requirement may be adjusted using the first flow control mechanism 109 on the attachment section 91 to provide a flow-related first pressure signal.

(Such mechanism 109 is symbolized as a variable orifice but in a specific embodiment, includes a secondary valve spool, not shown. However, the function of such secondary spool is substantially identical to that of a variable orifice.)

The pressure signal from the attachment section 91 is directed to the second priority valve 71 along the line 111. Optionally, the extend valve 85 may also have a second adjustable flow control mechanism 113 providing a second signal at the line 115 to control the prioritized flow through such valve 85.

The system 10 also has a two position high-flow valve 117 which derives it supply from the smaller pump 51. Such valve 117 may be shifted (to the position shown) to provide fluid to the extend valve 85 and attachment section 91. In its other position, the valve 117 directs fluid to the line 119.

For purposes of the following description, it is assumed that the smaller pump 51 has a rated output of 12 GPM and the larger pump 53 a rated output of 24 GPM, both at rated engine speed of about 2400 RPM. It is now apparent that if the flow requirements of the extend valve 85 and/or attachment section 91 are fairly modest, e.g., 9 GPM (and the indicated flow rates are representative of actual rates and rate ratios), the engine 15 can be operated at about 800–1000 RPM. That the operator will experience improved fuel economy and decreased noise and exhaust fumes is apparent.

If it is now assumed that the engine 15 is operating at or near rated speed, the total available flow is about 24 GPM from the large pump 53 alone or 36 GPM from the combined pumps 51, 53. When the extend valve 85 and/or the attachment section 91 is being operated, there is an excess of fluid available (after the second priority valve 71 has met the needs of such valve 85 and section 91) to operate the valves 73, 75, 77, 79, 81 and 83.

Figure 6:
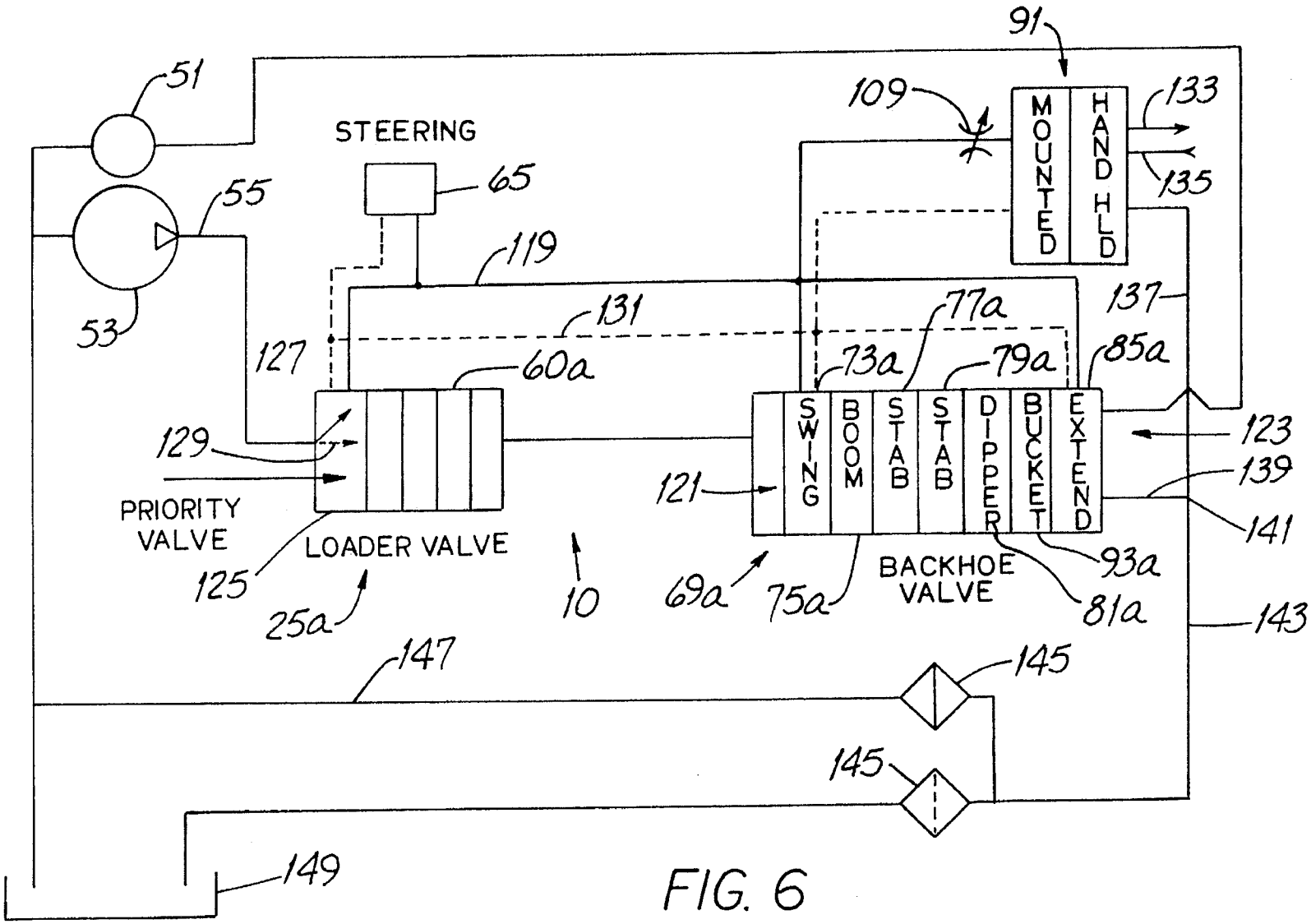
FIG. 6 is a block circuit diagram of a second embodiment of a hydraulic system suitable for use with the loader-backhoe of FIG. 1.

Referring next to FIG. 6, the second embodiment of the new system 10 will now be described. Such embodiment has first and second valve sections 25*a* and 69*a*, respectively. Such sections 25*a*, 69*a* are preferably connected in series.

The first section 25*a* includes loader valves 60*a* for controlling the loader bucket 21. The second section 69*a* has a first implement valve 121 and a second implement valve 123 and in a specific embodiment, such valves 121, 123 comprise a swing valve 73*a* and an extend valve 85*a*, respectively. The second section 69*a* also has a boom valve 75*a*, two stabilizer valves 77*a*, 79*a*, a dipper valve 81*a* and a bucket valve 83*a*.

Like the system 10 shown in FIG. 4, both of the valve sections 25*a*, 69*a* are fed by the first or larger pump 53. The system 10 has a priority valve 125 receiving fluid from the pump 53. Such valve 125, preferably attached to the first valve section 25*a*, is configured for movement between a first position and a second position as represented by the solid and dashed arrows 127 and 129, respectively.

As with any conventional priority valve, the valve 125 "prioritizes" flow to one line unless the requirements of the component attached to such line are satisfied. In the new system 10, the valve 125 flows fluid to the priority line 119 unless the requirements of the steering circuit 65 and the first and second implement valves 121, 123 are satisfied.

More specifically, in the first position, the priority valve 125 flows fluid to the steering circuit 65 and first and and second implement valves 121, 123 of the second section 69*a*. Such valves 121, 123 are in parallel with the steering circuit 65. If the machine 11 is of the type having an attachment valve section 91 for powering mounted and hand-held tools 105, 107, the priority valve 125 also flows fluid to the attachment valve section 91 when such priority valve 125 is in the first position.

If the requirements of the steering circuit 65 and of the first and second implement valves 121, 123 (and the optional attachment valve section 91) are satisfied, the priority valve 125 moves to the second position where it flows fluid to the first valve section 25*a* and to the second valve section 69*a*. No fluid is provided to the steering circuit 65 when the priority valve 125 is in the second position. (It is to be appreciated that the valve 125 can also modulate between the two positions and will do so in a manner to first satisfy the needs of the steering circuit 65 and the implement valves 121, 123.)

In another aspect of the invention, the system 10 has a pilot line 131 communicating a pressure signal to the priority valve 125. Such pilot line 131 is connected to the priority valve 125, to the first and second implement valves 121, 123 and to the attachment valve section 91 if the machine is equipped with such a section 91.

The attachment valve section has outflow and inflow lines 133 and 135, respectively, which direct flow to and from a tool like tools 105 and 107. The return lines 137 and 139 for the attachment section 91 and the second valve section 69*a*, respectively, are connected at a junction 141 and the flow in the line 143 is directed through filters 145 and to the pump inlet by line 147 or to the reservoir 149.

While the principles of the invention have been shown and described in connection with a few specific embodiments, it is to be understood clearly that such embodiments are exemplary and the invention is not limited thereby. For example, while the improved hydraulic system 10 is described in connection with a loader-backhoe, persons of ordinary skill in the art will, after appreciating the specification, understand how to apply such system 10 to other applications.

What is claimed:

1. In a hydraulic system for a loader-backhoe having (a) a digging bucket and a backhoe powered by the system and wherein:

the backhoe includes an extensible portion;

the hydraulic system includes first and second sections for powering the bucket and the backhoe, respectively;

the first section has a first priority valve connected thereto for prioritizing flow between the sect ions; and the second section includes (a) at least one implement valve controlling the backhoe, and (b) an extend valve controlling the extensible portion, the improvement wherein:

the second section includes a second priority valve prioritizing flow between the second implement valve and the extend valve; and the first section is connected between the first priority valve and the second priority valve.

2. The system of claim 1 wherein:

the first section includes a bucket control valve, the second priority valve has a supply port for receiving fluid;

the supply port is connected to the first valve section; and fluid flows in sequence from the first priority valve through the first valve section including through the bucket control valve to the second priority valve.

3. The system of claim 2 wherein:

the bucket control valve is configured for movement between a neutral position and an operating position; and the supply port receives fluid when the bucket control valve is in the neutral position.

4. In a hydraulic system for an earthmoving machine having (a) first and second earthmoving implements powered by the system and wherein:

the first and second earthmoving implements are powered by first and second valve sections, respectively;

both of the valve sections are fed by a first hydraulic pump providing a flow of fluid;

the machine has a hydraulic steering circuit;

the first valve section has a plurality of valves operable independently of the steering circuit;

the second valve section has a plurality of valves operable independently of the steering circuit;

the improvement wherein:

the system includes a priority valve receiving fluid from the pump and configured for movement between a first position and a second position;

in the first position, the priority valve flows fluid to the steering circuit and to the valves of the second valve section; and in the second position, the priority valve flows fluid to the valves of the first valve section and to the valves of the second valve section.

5. The system of claim 4 wherein:

the second valve section has first and second implement valves;

in the first position, the priority valve flows fluid to the steering circuit and to the first implement valve.

6. The system of claim 5 wherein the priority valve also flows fluid to the second implement valve.

7. The system of claim 6 further including a pilot line connected to the priority valve and to the first and second implement valves.

8. The system of claim 7 wherein the first and second valve sections are connected in series.

9. The system of claim 4 further including an attachment valve section and wherein:

in the first position, the priority valve also flows fluid to the attachment valve section.

10. The system of claim 9 wherein:

the second valve section has first and second implement valves;

in the first position, the priority valve also flows fluid to the steering circuit and to the first implement valve.

11. The system of claim 10 wherein in the first position, the priority valve also flows fluid to the second implement valve.

12. The system of claim 11 wherein the first and second valve sections are connected in series.

* * * * *